US007874958B1

(12) United States Patent
Ramsey, Sr.

(10) Patent No.: US 7,874,958 B1
(45) Date of Patent: Jan. 25, 2011

(54) LEG EXERCISING APPARATUS

(76) Inventor: Victor A. Ramsey, Sr., 72 Renner Ave., Newark, NJ (US) 07112

( * ) Notice: Subject to any disclaimer, the term of this patent is extended or adjusted under 35 U.S.C. 154(b) by 0 days.

(21) Appl. No.: 12/770,961

(22) Filed: Apr. 30, 2010

(51) Int. Cl.
*A63B 71/00* (2006.01)

(52) U.S. Cl. ..... 482/8; 482/1; 482/9; 482/901; 434/247

(58) Field of Classification Search ..... 482/1–9, 482/92, 121–137, 900–902; 434/29, 61, 434/247; 600/300
See application file for complete search history.

(56) References Cited

U.S. PATENT DOCUMENTS 4,535,985 A 8/1985 Mask
D299,843 S 2/1989 Brentham
4,872,670 A 10/1989 Nichols
4,988,300 A * 1/1991 Yamaguchi et al. ..... 434/247
5,006,072 A * 4/1991 Letovsky et al. ..... 434/61
5,284,465 A 2/1994 Homan, Jr.
5,547,382 A * 8/1996 Yamasaki et al. ..... 434/61
6,425,862 B1 * 7/2002 Brown ..... 600/300
6,605,024 B2 8/2003 Stearns
6,981,934 B1 1/2006 Shifferaw

* cited by examiner

*Primary Examiner*—Glenn Richman

(57) ABSTRACT

A leg exercising apparatus includes a support that includes a base having a top side and a post extending upwardly from the base. A housing is attached to a distal end of the post with respect to the base. The housing has a perimeter wall and a plurality of weight sensors is mounted within the housing. A seat is positioned on the housing. The weight sensors detect weight positioned on the seat. The sensors are positioned to detect weight differentiation positioned on sections of the seat. The sections at least include a right lateral section and a left lateral section. A control circuit is electrically coupled to the weight sensors. The control circuit emits a first signal when the weight sensors detect weight differentiations between the sensors within acceptable limits. The control circuit emits a second signal when the weight sensors detect weight differentiations outside of acceptable limits.

10 Claims, 4 Drawing Sheets

LEG EXERCISING APPARATUS

BACKGROUND OF THE DISCLOSURE

Field of the Disclosure

The disclosure relates to squat performing devices and more particularly pertains to a new squat performing device for teaching a person how to properly perform a squatting exercise.

SUMMARY OF THE DISCLOSURE

An embodiment of the disclosure meets the needs presented above by generally comprising a support that includes a base having a top side and a post attached to and extending upwardly from the base. A housing is attached to a distal end of the post with respect to the base. The housing has a perimeter wall and a plurality of weight sensors is mounted within the housing. A seat is positioned on the housing. The weight sensors are configured to detect weight positioned on the seat. The sensors are positioned to detect weight differentiation positioned on sections of the seat. The sections at least include a right lateral section and a left lateral section. A control circuit is electrically coupled to the weight sensors. The control circuit emits a first signal when the weight sensors detect weight differentiations between the sensors within acceptable limits. The control circuit emits a second signal when the weight sensors detect weight differentiations outside of acceptable limits.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
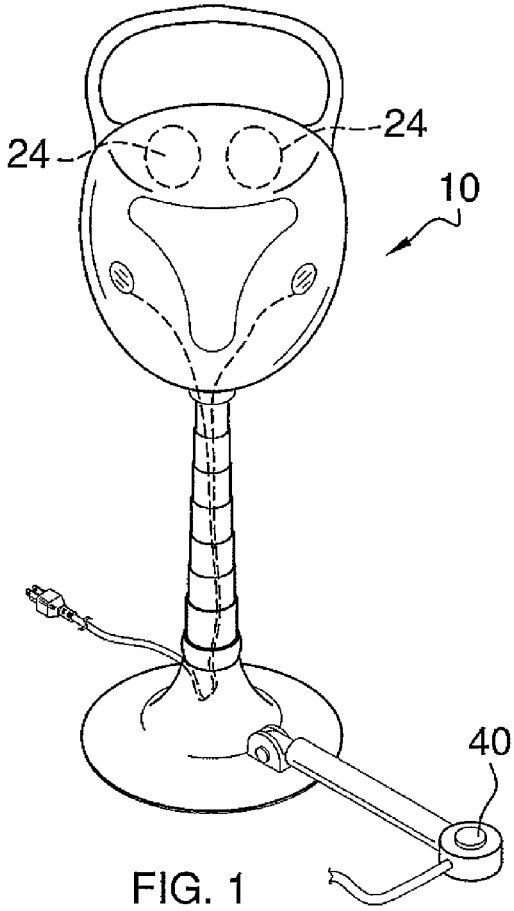
FIG. 1 is a front perspective view of a leg exercising apparatus according to an embodiment of the disclosure.
Figure 2:
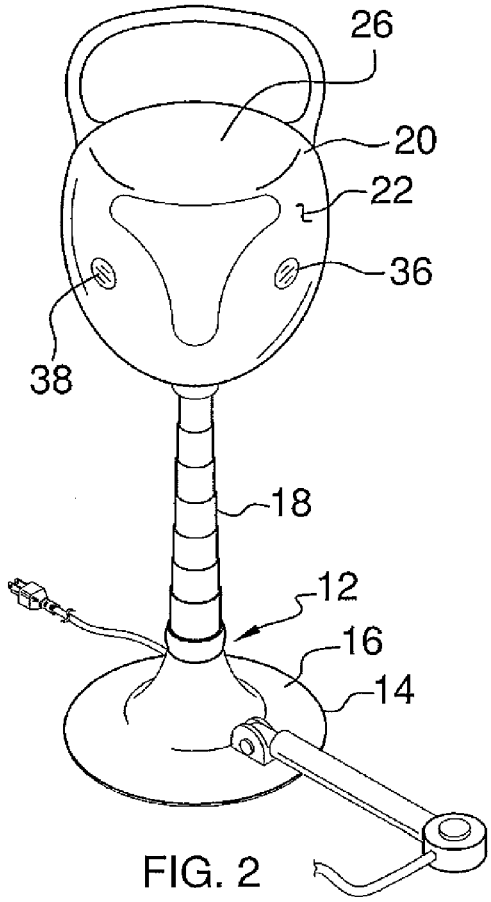
FIG. 2 is a front perspective view of an embodiment of the disclosure.
Figure 3:
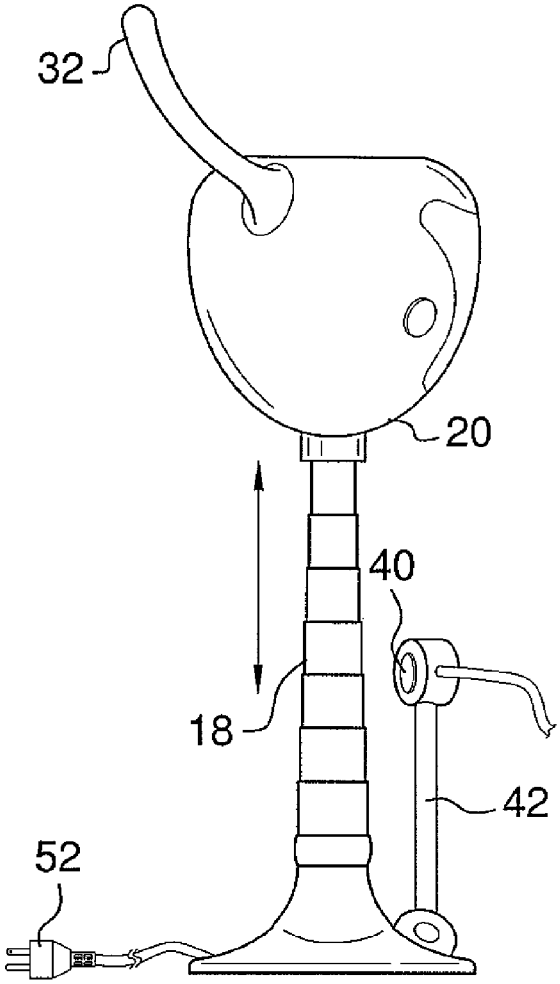
FIG. 3 is a side view of an embodiment of the disclosure.
Figure 4:
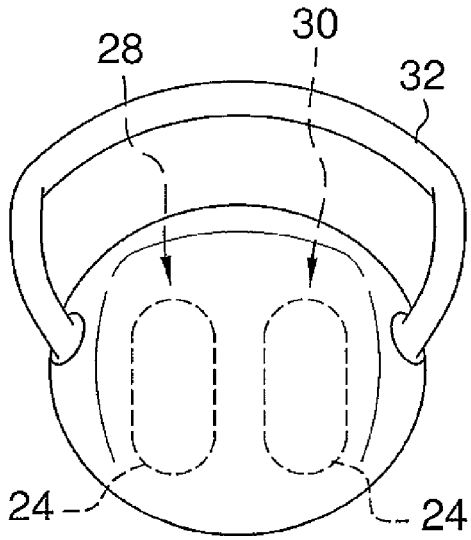
FIG. 4 is a top view of an embodiment of the disclosure.
Figure 5:
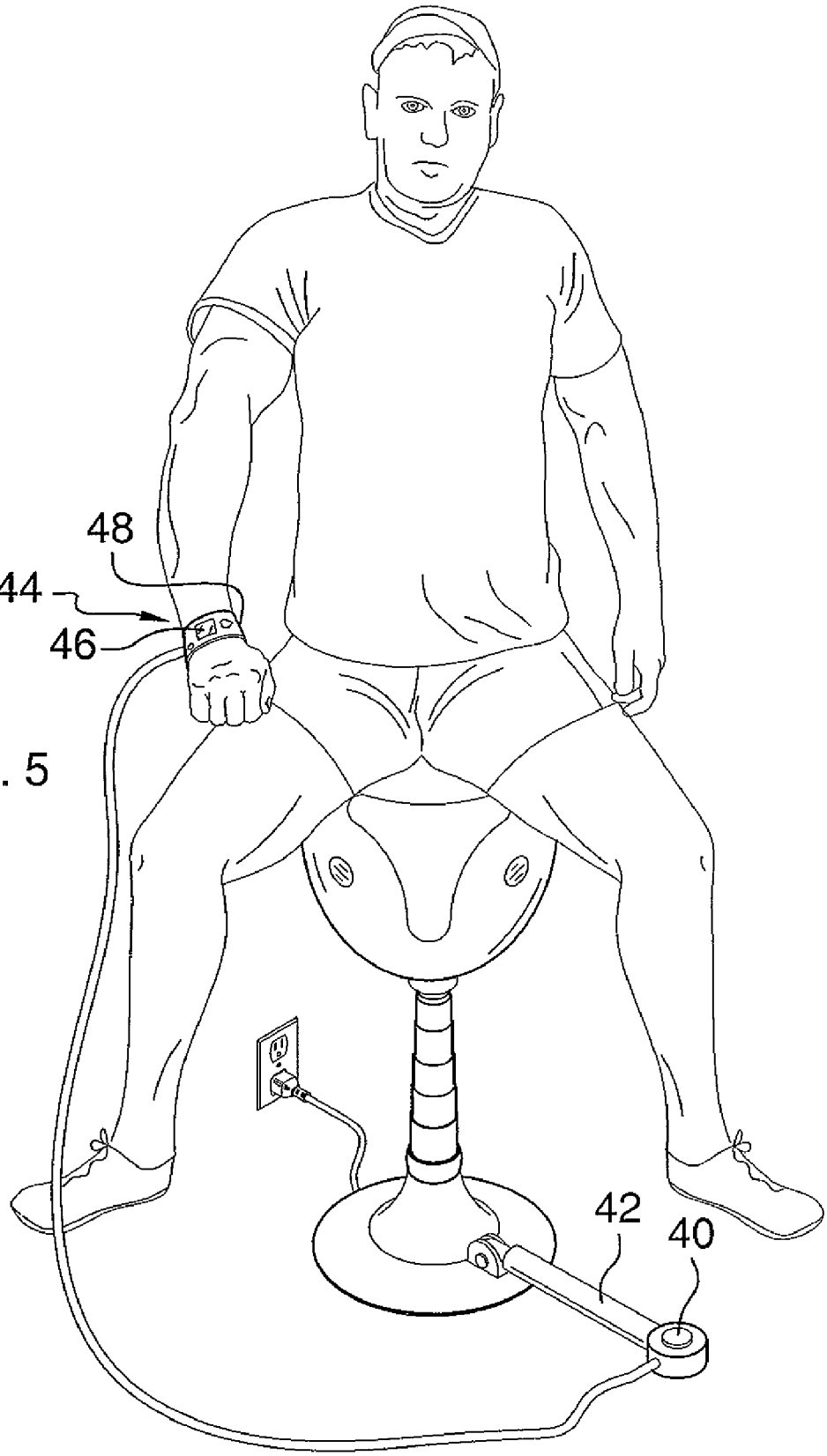
FIG. 5 is a front perspective in-use view of an embodiment of the disclosure.
Figure 6:
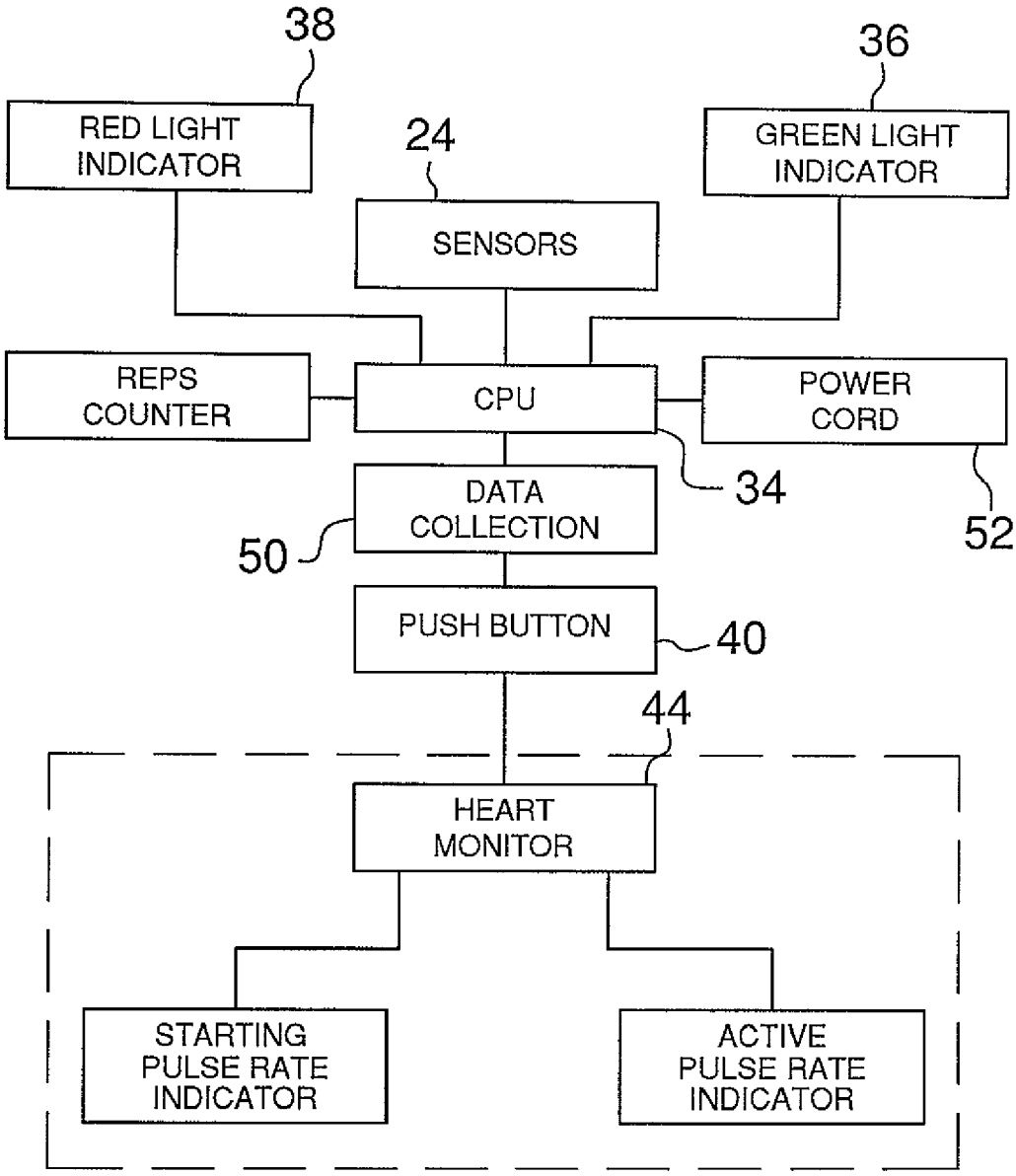
FIG. 6 is a schematic view of an embodiment of the disclosure.

With reference now to the drawings, and in particular to FIGS. 1 through 6 thereof, a new squat performing device embodying the principles and concepts of an embodiment of the disclosure and generally designated by the reference numeral 10 will be described.

As best illustrated in FIGS. 1 through 6, the leg exercising apparatus 10 generally comprises a support 12 that includes a base 14 having a top side 16 and a post 18 that is attached to and extends upwardly from the base 14. The post 18 is telescopic and has an adjustable height. The post 18 may comprise a conventional telescopic post that is adjustable by hand or it may be motorized for the convenience of the user. A housing 20 is attached to a distal end of the post 18 with respect to the base 14. The housing 20 has a perimeter wall 22. A plurality of weight sensors 24 is mounted within the housing 20.

A seat 26 is positioned on the housing 22. The weight sensors 24 are configured to detect weight positioned on the seat 26. The sensors 24 are positioned to detect weight differentiation positioned on sections of the seat 26. The sections at least include a right lateral section 28 and a left lateral section 30. However, a rear section may also be included. The weight sensors 24 may be contained in a single sensor configured to detect weigh variations across its entire surface. A backrest 32 is attached to and extending upwardly from the housing.

A control circuit 34 is electrically coupled to the weight sensors 24. The control circuit 34 emits a first signal when the weight sensors 24 detect weight differentiations between the sensors 24 within acceptable limits and emits a second signal when the weight sensors 24 detect weight differentiations outside of acceptable limits. The acceptable limits is less than a 10% weight differentiation between the sections though smaller differentiations may be selected depending on usage.

A first light emitter 36 and a second light emitter 38 are each positioned on the housing 20 and are electrically coupled to the control circuit 34. The first light emitter 36 is illuminated when the control circuit 34 emits the first signal and the second light emitter 38 is illuminated when the control circuit 34 emits the second signal.

An actuator 40 is electrically coupled to the control circuit 34. The control circuit 34 emits either the first or second signals while the actuator 40 is being actuated. The actuator 40 is mounted on a rod 42 that is attached to the support to position the actuator 40 laterally away from the support 12 to allow for easy actuation of the actuator 40 while a squat is being performed. The rod 42 may be pivotally coupled to the support 12.

A monitor 44 is electrically coupled to the circuit 34. The monitor 44 is a conventional health monitoring device configured to monitor a pulse rate of a person on which the monitor 44 is positioned. The monitor 44 includes a display 46 for displaying the pulse rate as well as a strap 48 for releasably securing the monitor 44 to a person's arm. Data collected by the monitor 44 and the control circuit 34 may be stored on electronic memory 50. Additionally, the number of times the weight sensors 24 detect weight may tracked. A power plug 52 is electrically coupled to the control circuit 34 to power the apparatus 10.

In use, the seat 26 height is adjusted as needed by a user and then user begins to perform squats wherein they stand up and then squat down until they are seated on the seat 26. They then repeat this action. As they approach the seat 26, the person actuates the actuator 40 to activate the weight sensors 24. The weight sensors 24 will detect the weight of the person and determine if they are properly balancing their weight on both legs. If the person is relatively balanced, the first light emitter 36, which may be green, is illuminated. If the person is unbalanced, the second light emitter 38, which may be red, is illuminated. In this feedback will tell the person if they are properly performing the squats. The person may, if desired, perform squats while also lifting weights.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A squat assisting apparatus comprising:

a support including a base having a top side and a post being attached to and extending upwardly from said base;

a housing being attached to a distal end of said post with respect to said base, said housing having a perimeter wall, a plurality of weight sensors being mounted within said housing;

a seat being positioned on said housing, said weight sensors being configured to detect weight positioned on said seat, said sensors being positioned to detect weight differentiation positioned on sections of said seat, said sections at least including a right lateral section and a left lateral section; and a control circuit being electrically coupled to said weight sensors, said control circuit emitting a first signal when said weight sensors detect weight differentiations between said sensors within acceptable limits, said control circuit emitting a second signal when said weight sensors detect weight differentiations outside of acceptable limits.

2. The apparatus according to claim 1, further including a backrest being attached to and extending upwardly from said housing.

3. The apparatus according to claim 1, wherein said acceptable limits is less than a 10% weight differentiation between said sections.

4. The apparatus according to claim 1, further including a first light emitter and a second light emitter each being positioned on said housing and being electrically coupled to said control circuit, said first light emitter being illuminated when said control circuit emits said first signal, said second light emitter being illuminated when said control circuit emits said second signal.

5. The apparatus according to claim 1, further including an actuator being electrically coupled to said control circuit, said control circuit emitting either said first or second signals while said actuator is being actuated.

6. The apparatus according to claim 5, wherein said actuator is mounted on a rod being attached to said support to position said actuator laterally away from said support to allow for easy actuation of said actuator while a squat is being performed.

7. The apparatus according to claim 4, further including an actuator being electrically coupled to said control circuit, said control circuit emitting either said first or second signals while said actuator is being actuated.

8. The apparatus according to claim 7, wherein said actuator is mounted on a rod being attached to said support to position said actuator laterally away from said support to allow for easy actuation of said actuator while a squat is being performed.

9. The apparatus according to claim 1, further including a monitor being electrically coupled to said circuit, said monitor being configured to monitor a pulse rate of a person on which said monitor is positioned, said monitor including a display for displaying said pulse rate, said monitor including a strap for releasably securing said monitor to a person's arm.

10. A squat assisting apparatus comprising:

a support including a base having a top side and a post being attached to and extending upwardly from said base, said post being telescopic and having an adjustable height;

a housing being attached to a distal end of said post with respect to said base, said housing having a perimeter wall, a plurality of weight sensors being mounted within said housing;

a seat being positioned on said housing, said weight sensors being configured to detect weight positioned on said seat, said sensors being positioned to detect weight differentiation positioned on sections of said seat, said sections at least including a right lateral section and a left lateral section, a backrest being attached to and extending upwardly from said housing;

a control circuit being electrically coupled to said weight sensors, said control circuit emitting a first signal when said weight sensors detect weight differentiations between said sensors within acceptable limits, said control circuit emitting a second signal when said weight sensors detect weight differentiations outside of acceptable limits, said acceptable limits being less than a 10% weight differentiation between said sections;

a first light emitter and a second light emitter each being positioned on said housing and being electrically coupled to said control circuit, said first light emitter being illuminated when said control circuit emits said first signal, said second light emitter being illuminated when said control circuit emits said second signal;

an actuator being electrically coupled to said control circuit, said control circuit emitting either said first or second signals while said actuator is being actuated, said actuator being mounted on a rod being attached to said support to position said actuator laterally away from said support to allow for easy actuation of said actuator while a squat is being performed; and a monitor being electrically coupled to said circuit, said monitor being configured to monitor a pulse rate of a person on which said monitor is positioned, said monitor including a display for displaying said pulse rate, said monitor including a strap for releasably securing said monitor to a person's arm.

* * * * *